US009114297B1

(12) United States Patent
Saumell

(10) Patent No.: US 9,114,297 B1
(45) Date of Patent: Aug. 25, 2015

(54) DEVICE FOR IMPROVING A USER'S BASEBALL SWING

(71) Applicant: Jorge Saumell, Miami, FL (US)

(72) Inventor: Jorge Saumell, Miami, FL (US)

( * ) Notice: Subject to any disclaimer, the term of this patent is extended or adjusted under 35 U.S.C. 154(b) by 0 days.

(21) Appl. No.: 14/171,794

(22) Filed: Feb. 4, 2014

(51) Int. Cl.
*A63B 69/00* (2006.01)
*A63B 69/40* (2006.01)

(52) U.S. Cl.
CPC ..... *A63B 69/0075* (2013.01); *A63B 69/0002* (2013.01)

(58) Field of Classification Search
CPC ..... A63B 69/0002; A63B 69/0075; A63B 57/0006; A63B 69/0053; A63B 69/409
USPC ..... 473/417, 418, 419, 422, 451, 135; 124/56, 75
See application file for complete search history.

(56) References Cited

U.S. PATENT DOCUMENTS 3,018,769 A * 1/1962 Parsoneault ..... 124/50
3,887,182 A * 6/1975 Breslow ..... 473/418
4,207,857 A * 6/1980 Balka, Jr. ..... 124/56
4,564,195 A * 1/1986 McClure et al. ..... 473/418
4,575,080 A * 3/1986 Miles ..... 473/418
4,858,921 A * 8/1989 Eustice et al. ..... 473/418
4,877,243 A * 10/1989 Taylor ..... 473/451
5,011,144 A * 4/1991 Marello et al. ..... 473/418
5,145,176 A * 9/1992 Lipson ..... 473/135
5,257,615 A * 11/1993 Jones ..... 124/56
5,507,271 A * 4/1996 Actor ..... 124/56
7,294,071 B1 * 11/2007 Saumell ..... 473/451
7,846,045 B1 * 12/2010 Kendall ..... 473/418
7,874,942 B2 * 1/2011 Auzoux et al. ..... 473/418
8,678,955 B2 * 3/2014 McKendrick et al. ..... 473/418
2002/0198068 A1 * 12/2002 Jordan ..... 473/418
2008/0009373 A1 * 1/2008 Binder et al. ..... 473/418

* cited by examiner

*Primary Examiner* — Mitra Aryanpour
(74) *Attorney, Agent, or Firm* — Lawrence J. Gibney, Jr.

(57) ABSTRACT

This device will train an individual to strike a baseball or softball using a machine that is suitable for all outdoor and indoor applications and can be operated either manually or remotely. A ball feed rack has been incorporated into the original device to make the operation of the device as automatic as possible while still maintaining the features of the original patent.

1 Claim, 3 Drawing Sheets

DEVICE FOR IMPROVING A USER'S BASEBALL SWING

CROSS REFERENCES TO RELATED APPLICATIONS

This is an improvement patent that was previously issued to the same applicant with U.S. Pat. No. 7,294,071 on Nov. 13, 2007.

BACKGROUND OF THE INVENTION

A. Field of the Invention

This is a device which relates to a hitting training device and specifically a device to teach an individual to hit a baseball or softball. A stream of air is used to suspend the ball or direct the travel of the ball using a stream of air through a nozzle. In the prior patent the nozzle would only travel between one hundred forty degrees and one hundred and eighty degrees of arc and the ball would need to be placed above the nozzle after each swing. In this application an automatic ball feeder has been added to that the machine can be as automatic as possible. A remote control feature has been added to insure that the operator can operate the device remotely.

B. Prior Art

These are four improvements over the prior patent that was issued to the same applicant with U.S. Pat. No. 7,294,071. The prior patent was compromised of a housing, which contains a blower and a nozzle that enabled the ball to be directed to a certain area.

This patent improves by allowing the nozzle to rotate completely around in a circle and the addition of a ball feeding machine to make the operation of this device as automatic as possible. The movement of the joint tube and nozzle is approximately one-hundred eighty degrees to direct the flow of air to further simulate a pitch and a remote control device for ease of operation.

BRIEF SUMMARY OF THE INVENTION

This is a device that relates to a baseball or softball hitting aid, specifically a device to teach an individual to hit a baseball or softball. This device uses a stream of air to suspend a ball a predetermined distance from the end of a nozzle.

This device rests on a base. A housing, which is secured to the base, contains a blower motor, a synchronous motor and all associated electrical connections. Levelers or foot screws on the base allow the device to be positioned level on the ground surface or be tilted, if desired or necessary.

Contained in the housing is a blower motor (not depicted) that provides a stream of air through a joint tube and nozzle to suspend a ball at a certain distance from the end of the nozzle. The tube that secures the nozzle is attached to the housing and permits the stream of air from the blower motor to travel through the tube and exit through the nozzle.

The joint tube, which is made from rigid plastic, that is attached to the housing can come in different sizes and is slightly angled. The nozzle, which is probably also made from rigid plastic is secured to one end of the joint tube and is straight. Different lengths of joint tubes (from four to six and ten inches) and the nozzle (approximately seven inches) may be used depending on the desires of the consumer.

The blower motor is turned on and off by a switch and the stream of air is directed through the top of the housing through a joint tube and a nozzle. The angled joint tube can be tilted so that an angle of between thirty and forty-five degrees is formed relative with the ground.

Ideally the angle of the joint tube and nozzle should be adjusted to a range of thirty to forty-five degrees from the ground, using the four leveler legs or foot screws under the machine to tilt it forward and/or backward to obtain the 30 degree to 45 degree angle. This angle will place the ball at the desired distance from the end of the nozzle and allow the player to strike the ball without hitting the nozzle.

A synchronous motor (not depicted), which operates at a constant speed is provided to allow the joint tube and nozzle to move from in a complete circle while suspending a ball.

A ball feeder that is positioned in close proximity to the device will automatically feed another ball to be suspended. A predetermined amount of balls can be stored in the ball feeder. A switch to release the next ball will be incorporated to allow the ball to become suspended above the nozzle. In this manner the device becomes relatively automatic for the person as he or she takes practice swings.

The power source for the device can be either battery or alternating current. In order to protect the electrical interior components of the device a fuse that was not incorporated into the original patent has been integrated into the electrical system. A separate switch for the blower motor and synchronous motor is included to operate these components separately and independently of each other, if needed.

Additionally a falling safe or tilt switch has been added to protect the player as well as the internal components of the machine from damage. In operation if the device begins to tilt beyond a certain number of degrees the electrical supply to the machine will be interrupted. This will prevent the device from falling to the ground and blowing sand or dirt into a player's face and possibly harming a player.

A synchronous motor operates the mechanism that allows the joint tube and nozzle to move in a complete circle. It is important to use a synchronous motor in order to insure a constant speed as the tube and nozzle moves in a circle.

In operation the blower motor is turned on and produces a stream of air which is directed through a small bent joint tube and a nozzle. A ball is placed over the nozzle and will remain suspended approximately seven inches from the nozzle. The blower motor is sized to produce a stream of air that is capable of suspending a baseball or a softball.

The ball may also be placed in a vertical position by changing the joint tube that is attached to the housing. The vertical positioning is contemplated for the beginner batter. Additionally, the joint tube that is rigid and is secured to the housing may be slightly bent for the more advanced hitter. When the blower motor is turned on, the ball is suspended slightly over the nozzle so that the batter can strike the ball.

A remote control device may be used for additional convenience or for instructional purposes.

Because the device will be used in outdoor environments the base and housing should be durable and hard plastic is probably a preferred choice of material.

NUMBERING REFERENCES

5 Device
6 Base

10 Tube
14 Nozzle
15 Housing
20 Levelers
35 Remote Control
45 Joint Seal Tube
60 Ball Feeder
65 Control Box
70 Sensor
75 Ball Release Mechanism

DETAILED DESCRIPTION OF THE EMBODIMENTS

This device 5 to simulate a pitch can be operated in three separate and distinct manners and those ways have been previously described in the prior patent.

This device 5 is used to suspend a ball in the air using a stream of air that is generated by a blower (not depicted) and operates by a synchronous motor (not depicted) that is contained in a housing 15. In the prior patent the direction of the stream of air may be varied to simulate different kinds of pitches. That feature is also maintained in this patent although the method to vary the direction can be altered.

This device may be used by the beginner as well as the more experienced batter depending on the positioning of the nozzle and the direction of the air stream.

Figure 1:
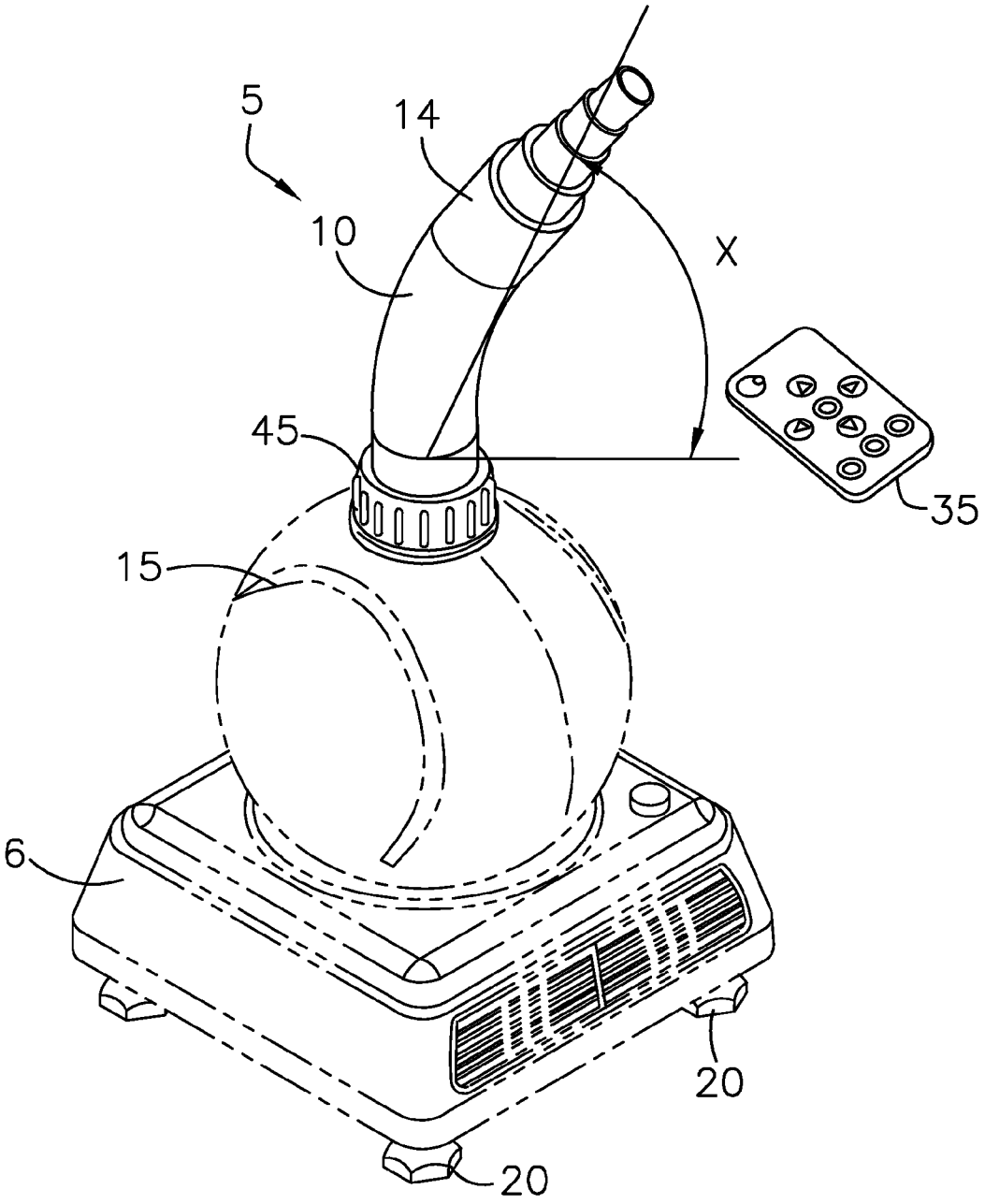
FIG. 1 is an isometric view of the assembled product.
Figure 1A:
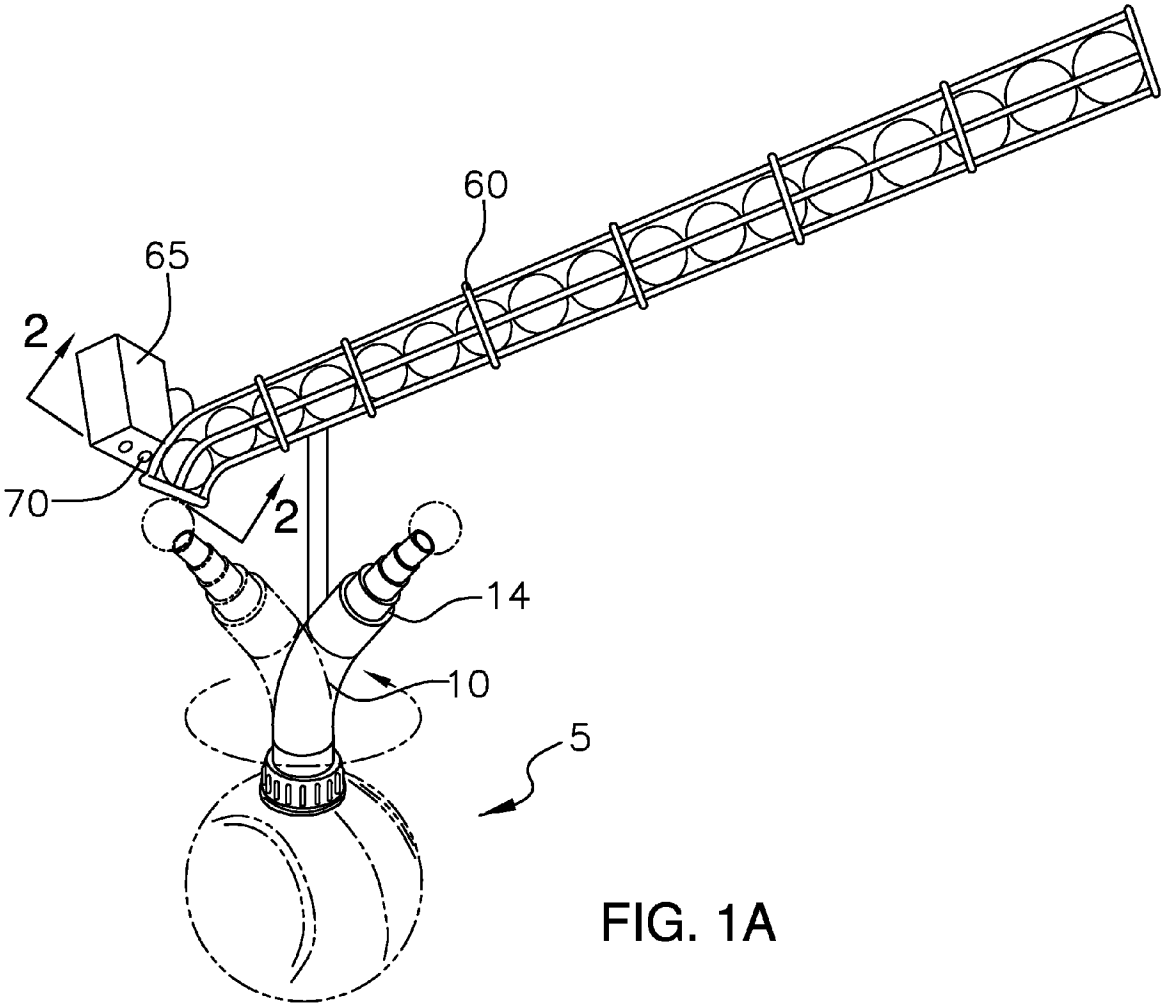
FIG. 1A is an isometric view of the device with the ball feeder.
Figure 2A:
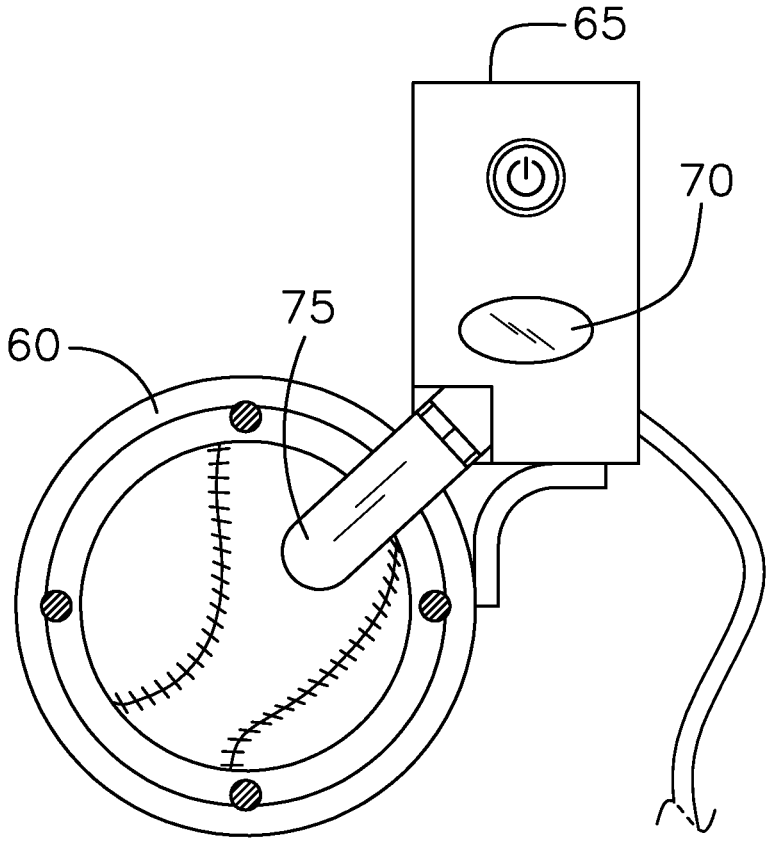
FIG. 2A is a cross sectional view according to Line 2-2 on FIG. 1A.

In operation the tube 10 and nozzle 14 will rotate in a complete circle. This permits the utilization of a ball feeder 60 that stores a predetermined amount of balls as depicted in FIG. 1A. At one end of the ball feeder is a ball release mechanism 75 that will keep the balls in the ball feeder 60 until the appropriate time.

A sensor 70 on a control box 65 will operate the ball release mechanism 75 so that as the nozzle 14 rotates in close proximity to the sensor the ball release mechanism will allow the next ball the fall and become suspended above the nozzle.

In this manner the operation of the device can be automatic and not require a human to reposition the ball above the stream of air as the nozzle rotates.

Additionally a remote control device 35 can also be incorporated to ensure the smooth operation of the device and permit the machine to be stopped if needed.

The nozzle 14, which is straight, is placed in one end of the joint tube 10. The ideal angle that is formed between the tube nozzle and the ground is thirty-five degrees. The angle relative to the ground may be altered to a range of thirty to forty degrees, as reference by "X" in FIG. 1, by adjusting the joint tube 10. A joint tube seal 45 is provided at the junction of the joint tube and the housing to prevent the escape of air.

As the nozzle rotates in a complete circle the sensor 70 on the control box 65 will permit the movement of the ball release 75. As the ball release is moved a ball from the ball feed rack 60 is positioned on the top of the stream of air.

The device 5 rests on a base 6, which supports a housing 15 that contains all the internal parts of the device. The housing 15 protects the internal workings of the device 5.

While the embodiments of the invention have been disclosed, certain modifications may be made by those skilled in the art to modify the invention without departing from the spirit of the invention.

The invention claimed is:

1. A device for training an individual to strike a baseball or softball, comprising:

a. a housing having a predetermined shape, said housing protecting internal working parts for the device;
wherein the housing rests on a base;

b. a base, the base supports the housing and includes a plurality of foot screws;
said foot screws permit the angling of the base relative to the ground;

c. a blower;
wherein the blower includes a motor, which produces a stream of air, the blower directs the stream of air through a joint tube and nozzle assembly;

d. a joint tube and nozzle assembly;
wherein the joint tube is secured to the nozzle assembly;
wherein the stream of air flowing from the blower motor through the joint tube and nozzle assembly is capable of suspending a ball;
wherein the joint tube and nozzle assembly form an angle relative to the ground;

e. a joint tube seal;
wherein said joint tube seal prevents the loss of air through the nozzle assembly;

f. a synchronous motor;
wherein the synchronous motor allows the joint tube and nozzle assembly to move in a complete circle;

g. a remote control mechanism;
said remote control mechanism permits the operation of the device remotely;

h. a power supply; the power supply includes appropriate electrical connections in order to operate electrical components for the device;
wherein a fuse is provided in the electrical connections, together with a tilt switch to prevent injury to the device and an end user;

i. a ball feed rack;
wherein a plurality of balls can be stored in the ball feed rack; and j. a sensor; the sensor operates a ball release; said ball release is positioned to keep plurality of the balls from exiting the ball feed rack.

* * * * *